United States Patent [19]

Little

[11] 4,178,655

[45] Dec. 18, 1979

[54] COUNTERBALANCE MECHANISM

[75] Inventor: Carl H. Little, St. Louis, Mo.

[73] Assignee: Weber-Knapp Company, Jamestown, N.Y.

[21] Appl. No.: 950,560

[22] Filed: Oct. 12, 1978

[51] Int. Cl.[2] ..... E05F 3/00

[52] U.S. Cl. ..... 16/52; 16/56; 16/DIG. 9; 16/DIG. 10; 16/DIG. 21; 217/60 C; 292/338

[58] Field of Search ..... 16/52, 56, 65, DIG. 9, 16/DIG. 10, DIG. 21, 49; 280/710; 188/300, 311, 313; 267/34, 64 R; 298/22 R; 220/345, 348; 292/262, 338; 217/60 R, 60 B, 60 C, 60 D, 60 F; 92/51, 52

[56] References Cited

U.S. PATENT DOCUMENTS

| | | | |
|---|---|---|---|
| 3,143,757 | 8/1964 | Quinn | 16/52 X |
| 3,145,055 | 8/1964 | Carter | 298/22 R |
| 3,376,795 | 4/1968 | Allen | 267/34 X |
| 3,595,551 | 7/1971 | Ortheil | 267/34 X |
| 3,625,540 | 12/1971 | Jewell | 280/710 |
| 3,963,101 | 6/1976 | Stadelmann et al. | 248/354 H X |
| 4,012,055 | 3/1977 | Ottow | 267/34 X |

OTHER PUBLICATIONS

| | | | |
|---|---|---|---|
| 1263666 | 2/1972 | United Kingdom | 16/52 |

*Primary Examiner*—Werner H. Schroeder
*Assistant Examiner*—Moshe I. Cohen
*Attorney, Agent, or Firm*—Bean, Kauffman & Bean

[57] ABSTRACT

A mechanism for use in counterbalancing the weight of a lid or closure incident to movements thereof between closed and open portions is in the form of a spring pressurized, hydraulic piston-cylinder arrangement. The mechanism preferably includes means providing hydraulic damping characteristics for both the fully extended and contracted conditions of the mechanism.

5 Claims, 3 Drawing Figures

COUNTERBALANCE MECHANISM

BACKGROUND OF THE INVENTION

Spring motors comprising telescopically mounted piston-cylinder arrangements, wherein a compression spring device is employed to apply pressure to a confined reservoir of hydraulic fluid in order to effect extension of a piston rod are well known, as evidenced for instance by U.S. Pat. Nos. 3,145,055; 3,145,056; and 3,182,564. Structurally similar devices have also been employed in numerous other environments, as generally illustrated by U.S. Pat. Nos. 2,747,860; 3,143,757; 3,381,952; 3,442,051; 3,625,540 and 3,963,101.

SUMMARY OF THE INVENTION

A counterbalance mechanism of the present invention is in the nature of a spring motor and includes telescopically arranged inner and outer cylinders; the inner cylinder carrying adjacent its inner end an outer piston head for dividing the outer cylinder into first and second chambers of inversely varying volume. A piston rod is telescopically received within the inner cylinder and carries an inner piston head adjacent its inner end. The inner cylinder is continuously biased towards the inner end of the outer cylinder, thereby tending to effect the flow of hydraulic fluid from the second chamber into the inner cylinder for the purpose of extending the piston rod.

In a preferred form of the invention, a metering orifice provides flow communication betwen the second chamber and the interior of the inner cylinder and the inner end of the outer cylinder and the inner piston head are fitted with extensions alternately received within the orifice incident to telescopic movements of the mechanism adjacent its fully extended and fully contracted conditions, respectively. The utilization of an inner cylinder, which serves to carry an outer piston head and is mounted for telescopic movements relative to both an outer cylinder and a piston rod, produces advantages over prior counterbalance or spring motor constructions employing an annular piston head slidably supported on a stationary inner cylinder. Specifically, the present construction avoids the need for providing a sliding hydraulic seal between the inner cylinder and its piston head and provides for an increase in displaced volume of hydraulic fluid for a given length of outer piston head travel.

The above described construction also possesses the advantage that metered flow of hydraullic fluid may be effected, as the mechanism approaches both its fully extended and contracted conditions, whereby shock loading of the mechanism may be reduced without retarding speed operation intermediate these extreme or end conditions.

DRAWINGS

The nature and mode of operation of the present invention will now be more fully described in the following detailed description taken with the accompanying drawings wherein.

DETAILED DESCRIPTION

Figure 1:
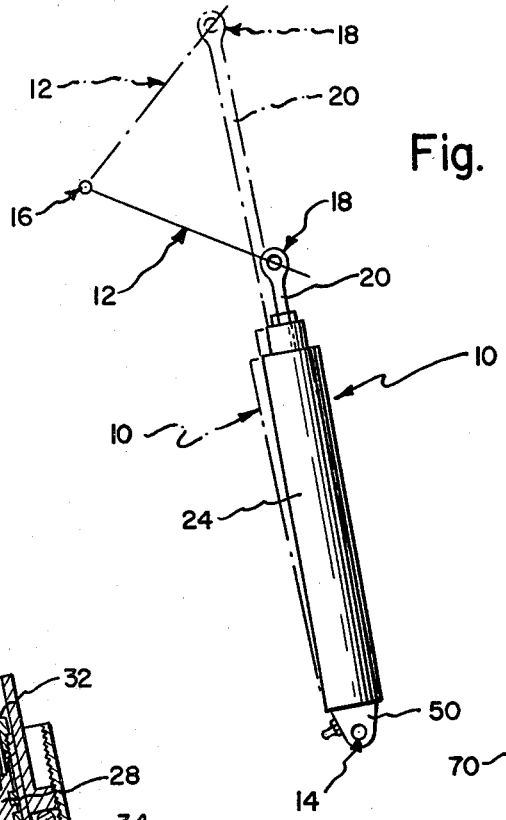
FIG. 1 is a side elevatlonal view illustrating the counterbalance mechanism of the present invention in operative association with a lid.

Reference is first made to FIG. 1 wherein a counterbalance mechanism of the present invention is generally designated as 10 and shown as being operationally associated with a lid or lid supporting/operating mechanism generally designated as 12, whose weight is to be counterbalanced at least in part incident to movement of the lid between its closed and open positions shown in full and broken line, respectively. It will be understood that the term "lid", as used herein, is not meant to be limiting, since mechanism 10 possesses utility in providing counterbalance support for diverse devices including vehicle doors.

In the installation shown as by way of example in FIG. 1, mechanism 10 and lid 12 are mounted on a suitable support, not shown, by fixed pivot devices 14 and 16, respectively, and connnected to each other for relative movement by a pivot device 18.

Figure 3:
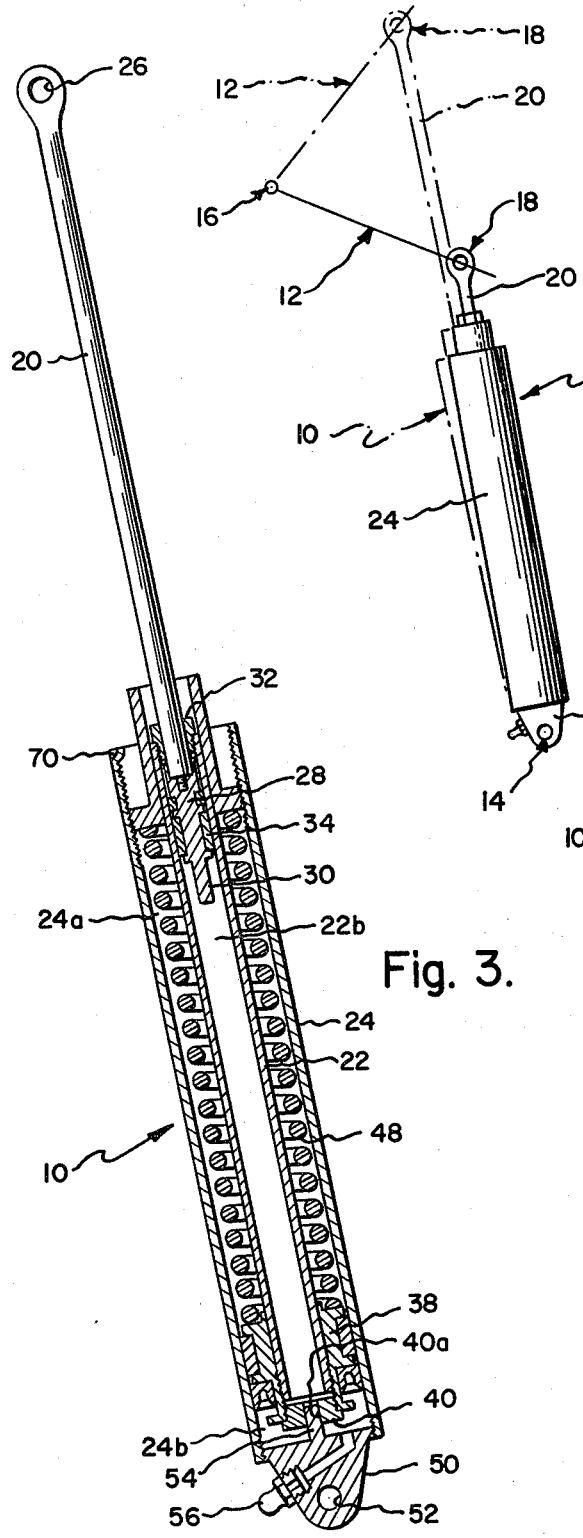
FIG. 3 is a vertical sectional view of the mechanism when in fully extended or lid open condition.
Figure 2:
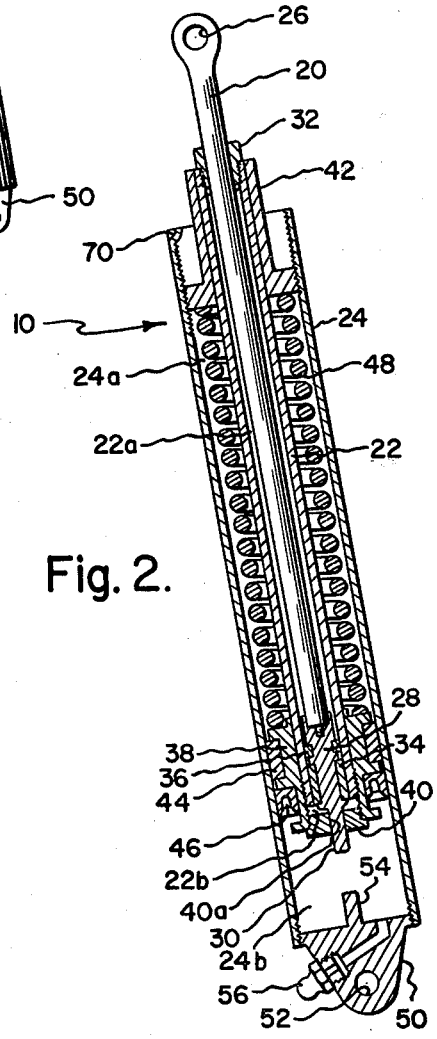
FIG. 2 is a vertical sectional view of the mechanism when in fully contracted or lid closed condition.

Now referring particularly to FIGS. 2 and 3, it will be apparent that mechanism 10 generally includes an inner piston rod 20, an inner cylinder 22 and an outer cylinder 24, which are concentrically arranged and adapted for axial sliding or telescopic movements relative to one another. More specifically, piston rod 20 is shown as having its relatively outer end formed with an attachment device in the form of an aperture 26 adapted for connection as part of pivot device 18 and as having its inner end fitted with an inner or relatively small piston head 28 formed with an axially extending projection 30. Piston rod 20 is slidably supported within inner cylinder 22 by a rod bushing 32 suitably fixed, as by screw threads, to the relatively outer end of the inner cylinder 22 and by a wear ring 34 carried by piston head 28. Piston head 28 additionally carries a suitable fluid seal device, such as may be defined by ring 36.

Inner cylinder 22 is shown as having its relatively inner end fitted with an outer or relatively large piston head 38, which in turn serves to define or mount a separately formed orifice cap 40 having a damping orifice **40*a*. Inner cylinder 22 is slidably supported within outer cylinder 24 by an adjustment nut 42 suitably fixed, as by screw threads, to the relatively outer or open end of the outer cylinder and by a wear ring 44 carried by outer piston head 38. Piston head 38 additionally carries a suitable fluid seal device, such as may be defined by ring 46. As will be apparent, piston head 38 serves to divide outer cylinder 24 into first or outer and second or inner chambers 24*a* and 24*b*, respectively, whose volumes vary inversely as the piston head moves axially within the outer cylinder. Piston head 38 also cooperates with adjustment nut 42 to provide end constraning or bearing surfaces for a suitable spring means, such as may be defined by a coil spring 48 disposed within chamber 24*a* concentrically intermediate the inner and outer cylinders. Chamber 24*a*** would also enclose a compressible fluid, such as air.

Outer cylinder 24 is shown as having its relatively inner or lower end closed by a closure or end cap 50, which is formed with an attachment device in the form of an aperture 52 adapted for connection as part of pivot device 14 and an inwardly facing and axially extending projection 54 disposed in axial alignment with projection 30 and damping orifice **40*a*. Further, closure 50 is preferably formed with a sealable hydraulic fitting 56** through which a charge of hydraulic fluid may be introduced into chamber 24b.

Inner piston head 28 and its associated sealing ring 36 serve to divide inner cylinder 22 into first or outer and second or inner chambers 22a and 22b, respectively, whose volumes vary inversely with the movement of piston head 28. Chamber 22a would normally enclose a compressible fluid, such as air, whereas chamber 22b is disposed in flow communication with chamber 24b via damping orifice 40a. While chambers 22a and 24a may be considered as being essentially sealed relatively to atmosphere in regard to the entrance of dirt, nonetheless manufacturing tolerances between the surfaces of piston rod 20 and bushing 32, and between the surfaces of inner cylinder 22 and adjustment nut 42 are normally such as to permit flow of atmospheric air into and out of these chambers, as required to prevent creation of such reduced or increased pressure conditions, as might adversely effect efficient operation of mechanism 10.

In that spring 48 would normally be subject to some degree of compression at all times and it is desirable to permanently retain the charge of hydraulic fluid within the mechanism, suitable means are employed to prevent unintentional/unauthorized removal of adjustment nut 42. Such means may be defined by deforming the outer or upper end of outer cylinder 24, as at 70.

In the fully contracted or lid closed condition of mechanism 10, as viewed in FIG. 2, the weight of lid 12 would normally force piston rod 20 to reside in its illustrated fully contracted or inserted position, wherein projection 30 is received within damping orifice 40a and inner piston head 28 bottoms out against orifice cap 40 and/or outer piston head 38. Preferably, however, the fully contracted condition of mechanism 10 would in practice be defined by a lid closed position defining stop, not shown, in which case the inner piston head would be prevented from actually engaging the orifice plate, as indicated in FIG. 2. In either case, the size of chamber 22b would be reduced to some minimum design value and essentially the entire charge of hydraulic fluid would be forced into chamber 24b, such that its size would be increased to some maximum design value. In this condition of mechanism 10, spring 48 is in its maximum state of compression. As will be apparent, manual adjustments of adjustment nut 42 axially relative to outer cylinder 24, will vary the compressive force or pre-load applied to spring 48 and thus the degree to which the weight of lid 12 is counterbalanced by mechanism 10, when the lid is in its closed position. Depending on lid installation requirements, the pre-load applied to spring 48 may be varied between values at which the counterbalancing torque established by mechanism 10 is greater than or less than the lid closing torque established by the force of gravity acting on the lid. In the former case, lid 12 would "pop-up" from its closed position upon release of a closure latch, not shown, whereas in the later case, some degree of manual force would be required to lift the lid from its closed position.

Upon movement of lid 12 from its closed position, spring 48 is permitted to expand, so as to force outer piston head 38 to move downwardly within outer cylinder 24. This serves to decrease in the size of chamber 24b and thereby force hydraulic fluid to flow through orifice 40a into chamber 22b and in turn force inner piston head 28 to extend or move outwardly relative to inner cylinder 22. Movement of piston heads 28 and 38 and the flow of hydraulic fluid continues until the fully extended condition of mechanism 10 is reached. This extended position, which is shown generally in FIG. 3, may be selectively defined, such as by engagement of inner piston head 28 with rod bushing 32, by the bottoming out of outer piston head 38 against closure cap 50, or by a lid open position defining stop, not shown. In any case, it is preferable that movement of outer piston head 38 be sufficient to effect insertion of projection 54 within orifice 40a before mechanism 10 assumes its fully extended or lid open condition.

As indicated above, spring 48 would normally remain in a partially compressed state, when mechanism 10 assumes its fully extended condition in order to continue to exert a counterbalancing force on lid 12. Preferably, the spring force would remain sufficient to create a counterbalance torque exceeding the lid closing torque produced by gravity in order to positively maintain the lid in its fully open position. Mechanism 10 may be designed/adjusted for diverse lid installation/operating requirements.

It will be understood that the diameters of projections 30 and 54 are sized relative to the diameter of orifice 40a, so as to provide for constricted flow of hydraulic fluid between chambers 24b and 22b coincident with movements of mechanism 10 into its fully contracted and extended conditions, respectively. In other words, projections 30 and 54 cooperate with orifice 40a to provide metering valves, which serve to restrain the speed of movement of piston heads 28 and 38, as they approach and move away from their positions illustrated in FIGS. 2 and 3, and thereby serve to cushion mechanism 10 and thus lid 12 against operational shock loads and/or provide for low speed lid movements adjacent its extreme operating positions. It will be understood that projections 30 and 54 are preferably axially sized to permit their removal from within orifice 40a, during a substantial portion of the operating cycle of mechanism 10 in order to permit relatively high speed movements of lid 12 intermediate its extreme or closed and open positions. It will also be understood that the damping effects described above may be varied for the contracted and extended conditions of mechanism 10 by selectively varying the relative lengths and/or diameters of projections 30 and 54. Alternatively, if desired, one or both of the projections may be omitted depending on installation requirements. Also, it is contemplated that orifice cap 40 may be dispensed with for constructions omitting projection 30 in which case the inner or lower open end of inner cylinder 22 would serve in place of the damping orifice to provide flow communication between chambers 22b and 24b.

I claim:

1. A counterbalance mechanism comprising in combination:

an outer cylinder having a closed inner end and an open outer end;

an inner cylinder telescopically received within said outer cylinder and having open inner and outer ends;

first means fixed adjacent said outer end of said outer cylinder for slidably supporting said outer end of said inner cylinder;

an outer piston head fixed to said inner cylinder for slidably supporting said inner end of said inner cylinder within said outer cylinder and for dividing said outer cylinder into first and second axially spaced chambers, said first chamber being arranged intermediate said outer piston head and said first means, said second chamber being arranged intermediate said outer piston head and said inner end of said outer cylinder;

resilient means disposed in said first chamber;

a piston rod telescopically received within said inner cylinder;

second means for slidably supporting an outer end of said piston rod;

an inner piston head fixed to an inner end of said piston rod for slidably supporting said inner end of said piston rod within said inner cylinder and for dividing said inner cylinder into first and second axially spaced chambers;

a charge of hydraulic fluid disposed in at least one of the second chambers and said second chambers being disposed in flow communication through said inner end of said inner cylinder, said mechanism being characterized as having a piston rod contracted condition, wherein said second chambers of said outer and inner cylinders have maximum and minimum values, respectively, and a piston rod extended condition wherein said second chambers of said outer and inner cylinders have minimum and maximum values, respectively, and in that said resilient means tends to move said outer piston head and said inner cylinder towards said inner end of said outer cylinder for placing said mechanism in said piston rod extended condition.

2. A counterbalance mechanism according to claim 1, wherein means mounted on said inner end of said inner cylinder defines a damping orifice for placing said second chambers in flow communication, said damping orifice being disclosed in axial alignment with said inner and outer cylinders and said piston rod, and at least one of said inner piston head and said inner end of said outer cylinder includes a projection sized for removable insertion within said orifice for limiting flow of hydraulic fluid therethrough.

3. A counterbalance mechanism according to claim 2, wherein a projection is formed on each of said inner piston head and said inner end of said outer cylinder, the projections carried by said inner piston head and said inner end of said outer cylinder are received within said orifice incident to placement of said mechanism in said contracted and extended conditions, respectively, and said projections are withdrawn from within said orifice intermediate said contracted and extended conditions.

4. A counterbalance mechanism according to claims 1, 2 or 3 wherein said resilient means is a spring disposed for opposite end bearing engagement with said first means and said outer piston head, and said first means is fixed to said outer cylinder for adjustment axially thereof for varying preloading of said spring.

5. A counterbalance mechanism comprising in combination:

inner cylinder means slidably supported for axial movement within an outer cylinder means and carrying an outer piston head means on an inner end thereof, said outer piston head means and a closed inner end of said outer cylinder means axially bounding a chamber;

flow metering means carried adjacent said inner end of said inner cylinder means for defining a metering orifice;

piston rod means slidably supported for axial movement within said inner cylinder means, an inner end of said piston rod means and said flow metering means axially bounding an other chamber disposed in flow communication with the first said chamber;

a charge of hydraulic fluid disposed within at least one of the chambers;

spring means tending to move said inner cylinder means and said outer piston head towards said inner end of said outer cylinder means whereby to cause flow of said hydraulic fluid from the first said chamber through said orifice and into said other chamber for extending said piston rod means, said inner end of said piston rod means and said inner end of said outer cylinder means each carrying a projection arranged in axial alignment with said orifice, the projections of said piston rod means and said outer cylinder means alternatively cooperating with said orifice for metering flow of said hydraulic fluid between said chambers incident to minimum volume conditions of said other chamber and the first said chamber, respectively.

* * * * *